US011033912B2

(12) United States Patent
Coutu et al.

(10) Patent No.: US 11,033,912 B2
(45) Date of Patent: Jun. 15, 2021

(54) MULTI-FUNCTIONAL SHOWER HEAD ATTACHMENT DEVICE WITH SUCTION AND PRESSURE CAPABILITY

(71) Applicants: Philip Coutu, Morrison, CO (US); Katherine Riley, Morrison, CO (US)

(72) Inventors: Philip Coutu, Morrison, CO (US); Katherine Riley, Morrison, CO (US)

( * ) Notice: Subject to any disclaimer, the term of this patent is extended or adjusted under 35 U.S.C. 154(b) by 116 days.

(21) Appl. No.: 16/558,053

(22) Filed: Aug. 31, 2019

(65) Prior Publication Data

US 2020/0070184 A1 Mar. 5, 2020

Related U.S. Application Data

(60) Provisional application No. 62/765,592, filed on Aug. 31, 2018.

(51) Int. Cl.
*B05B 1/18* (2006.01)
*E03C 1/04* (2006.01)

(52) U.S. Cl.
CPC ..... *B05B 1/185* (2013.01); *E03C 1/0408* (2013.01)

(58) Field of Classification Search
CPC ..... E03C 1/08; B05B 1/185
USPC ..... 4/601; 239/428.5
See application file for complete search history.

(56) References Cited

U.S. PATENT DOCUMENTS

2010/0258653 A1* 10/2010 Tanaka ..... B05B 1/18 239/428.5

* cited by examiner

*Primary Examiner* — Christine J Skubinna
(74) *Attorney, Agent, or Firm* — W&K IP

(57) ABSTRACT

A multi-functional shower head attachment device with suction and pressure capabilities enables users to induce a pressurized flow of liquid, or suction with handheld device selectively removably couplable to a conventional shower head. The device includes a housing containing a fluid transport network that is selectively manipulated along a valve translation path to selectively induce a negative pressure vacuum, and a pressurized discharge of fluid. The vacuum is generated as the pressurized fluid is diverted through a configuration of conduits, past a venturi channel and through a secondary exit port; thereby creating the vacuum through adjacent, fluidly coupled conduits. The pressurized fluid discharge is generated as the incoming pressurized fluid is diverted directly through a series of conduits to an exit port. The housing is coupled to a handheld suction and pressure housing assembly through which the user washes, removes acne/oils, etc., with both suction and pressurized fluid discharge.

20 Claims, 8 Drawing Sheets

MULTI-FUNCTIONAL SHOWER HEAD ATTACHMENT DEVICE WITH SUCTION AND PRESSURE CAPABILITY

CROSS-REFERENCE TO RELATED APPLICATION

This application claims priority to U.S. Provisional Patent Application No. 62/765,592 filed Aug. 31, 2018, the entirety of which is incorporated by reference.

FIELD OF THE INVENTION

The present invention relates generally to a multi-functional shower head attachment device with suction and pressure capabilities, and, more particularly, relates to a multi-functional shower head attachment device that effectively and efficiently enables users to induce a pressurized flow of liquid or suction with handheld device selectively removably couplable to a conventional shower head or plumbing fixture.

BACKGROUND OF THE INVENTION

Typically, taking a shower involves lathering with soap and then rinsing off with a showerhead that has controllable water temperature. It is also possible to utilize a multifunction shower head that can discharge water in any of many different spray patterns, such as a fine spray, a coarse spray, or a pulsating spray. Of course, many other spray patterns may also be provided. Such shower heads are available in both wall-mounted and hand-held models. Therefore, the same internal mechanism should be usable in either model. However, showerheads can only discharge water as they don't have the capacity to also create a sucking effect at the nozzle head.

Therefore, a need exists to overcome the problems with the prior art as discussed above.

SUMMARY OF THE INVENTION

The invention provides a multi-functional shower head attachment device with suction and pressure capabilities that overcomes the hereinafore-mentioned disadvantages of the heretofore-known devices and methods of this general type and that effectively and efficiently enables users to induce a pressurized flow of liquid or suction with handheld device selectively removably couplable to a conventional shower head or plumbing fixture. The device includes a housing containing a fluid transport network that is selectively manipulated along a valve translation path to selectively induce a negative pressure vacuum, and a pressurized discharge of driving fluid through a water ejector configuration. The vacuum is generated as the pressurized driving fluid is diverted through a first configuration of conduits, past a venturi channel and through a secondary exit port; thereby creating the vacuum through adjacent, fluidly coupled conduits. The pressurized fluid discharge is generated as the pressurized driving fluid is diverted directly through a series of conduits to an exit port.

The housing is coupled to a handheld suction and pressure housing assembly through a flexible unit conduit. The generated vacuum and the pressurized fluid discharge create suction and pressurized fluid discharge, respectively, through a nozzle in the handheld suction and pressure housing assembly. Through the nozzle, a user can wash, shower, remove acne/oils, and perform other cleaning and personal hygiene functions with both suction and pressurized driving fluid discharge.

With the foregoing and other objects in view, there is provided, in accordance with the invention, a multi-functional plumbing fixture attachment device with suction and pressure capability that includes a housing defining an intake port, an exit port, a secondary exit port, and a valve port.

The device further includes a fluid transport network that is disposed within the housing. The fluid transport network has a first conduit coupled to the intake port of the housing. The fluid transport network also has a second conduit coupled to the exit port of the housing.

Additionally, the fluid transport network has a third conduit coupled to the exit port of the housing. The fluid transport network also has a fourth conduit coupled to the secondary exit port of the housing. In one embodiment, the fourth conduit forms a venturi channel. The fluid transport network also has a fifth conduit fluidly coupled to the fourth conduit at the venturi channel.

In some embodiments, the device comprises a valve housing disposed within and coupled to the housing. The valve housing has a valve stem extending through the valve port and coupled to a valve lever. The valve stem has an internal fluid bore. The valve stem further has a secondary internal fluid bore defined thereon that is structurally and fluidly independent from the internal fluid bore.

In one possible embodiment, the valve stem is operably configured to selectively translate in a valve translation path. Through this translation path, the valve stem is operably configured to have a vacuum position along the valve translation path with the first, second, third, fourth, and fifth conduits fluidly coupled to one another, the internal fluid bore fluidly uncoupled to the first, second, third, fourth, and fifth conduits. The vacuum position is also operably configured to generate a vacuum within the second conduit, the secondary internal fluid bore, and the fifth conduit.

Also, through this translation path, the valve stem is operably configured to have a pressurized discharge position along the valve translation path with the internal fluid bore, the first, second, and third conduits fluidly coupled to one another and fluidly uncoupled to the fourth and fifth conduits.

In some embodiments, the device includes a fluid source that is in fluid communication and selectively removably couplable with the intake port. The fluid source is operable to discharge a pressurized driving fluid through the intake port. In this manner, in the vacuum position, the pressurized driving fluid is diverted through the venturi channel in the fourth conduit, and through the secondary exit port 108. Thus, the driving fluid passing through the venturi channel creates the vacuum within the second conduit, the secondary internal fluid bore, and the fifth conduit. Also, in the pressurized discharge position, the pressurized driving fluid is diverted through the first conduit, the internal fluid bore, and the third conduit, whereby the pressurized driving fluid discharges through the exit port.

The device also includes a handheld suction and pressure housing assembly having a housing and a nozzle coupled to the housing. The nozzle defines a nozzle opening. Also, the nozzle is fluidly coupled to the exit port of the housing.

In accordance with another feature, the secondary internal fluid bore is structurally and fluidly independent from the internal fluid bore by a valve wall.

In accordance with another feature, the valve stem is operably configured to selectively translate within the valve housing and in a circular valve translation path up to 90°.

In accordance with another feature, the valve stem further includes an upper end, a lower end opposing the upper end of the valve stem, a left side, a right side opposing the left side of the valve stem, a left end, and a right end opposing the left end of the valve stem, and a stem length separating the left and right ends of the valve stem.

In accordance with another feature, the valve stem also comprises an outer surface surrounding the perimeter of the valve stem along the stem length and defining a first enclosed aperture disposed on the upper end of the valve stem, a second enclosed aperture disposed on the lower end of the valve stem and aligned with the first enclosed aperture, a third enclosed aperture disposed on the left side of the valve stem, a fourth enclosed aperture disposed on the right side of the valve stem, and a fifth enclosed aperture disposed on the lower end of the valve stem.

In another aspect of the present invention, the device also comprises a flexible unit conduit coupling the housing of the handheld suction and pressure housing assembly, and the valve housing.

In another aspect of the present invention, the vacuum position along the valve translation path includes the fourth enclosed aperture fluidly uncoupled to the first, second, third, fourth, and fifth conduits and the flexible unit conduit and the fifth enclosed aperture and the secondary internal fluid bore fluidly coupled to the first, second, third, fourth, and fifth conduits and the flexible unit conduit.

In another aspect of the present invention, the pressurized discharge position along the valve translation path includes the first and fourth enclosed apertures and the internal fluid bore fluidly coupled to the first, second, and third conduits and the flexible unit conduit and the fifth enclosed aperture and the secondary internal fluid bore fluidly uncoupled to the first, second, third, fourth, and fifth conduits and the flexible unit conduit.

In another aspect of the present invention, the conduits of the fluid transport conduct network include at least one of the following: at least one straight tube coupled to the housing of the housing, at least one elbow tube coupled to the housing, and a spout coupled to the valve housing.

In another aspect of the present invention, when the valve translation path is in the vacuum position, the nozzle opening is operable to suck air into the housing of the handheld suction and pressure housing assembly and discharges the air through the secondary exit port.

In accordance with another feature, when the valve translation path is in the pressurized discharge position, the nozzle opening is operable to discharge the pressurized driving fluid.

In accordance with another feature, the nozzle opening is fluidly coupled to at least one secondary attachment.

Although the invention is illustrated and described herein as embodied in a shower head attachment device with suction and pressure capabilities, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
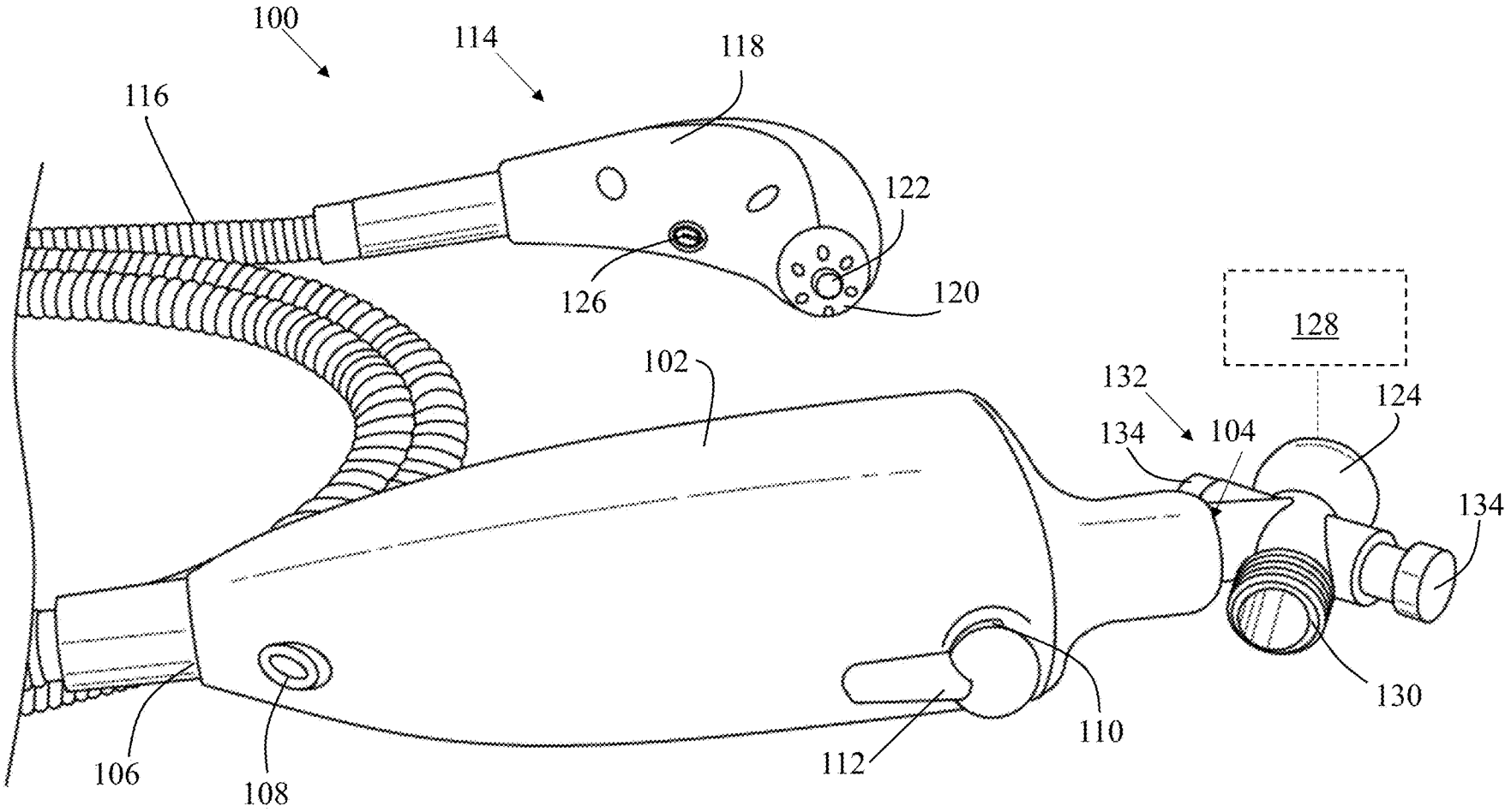
FIG. 1 is a perspective view of an exemplary multifunctional shower head attachment device, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient multi-functional shower head attachment device 100 that overcomes the hereinafore-mentioned disadvantages of the heretofore-known devices and methods of this general type and that effectively and efficiently enables users to induce a pressurized flow of liquid or suction with handheld device selectively removably couplable to a fluid inlet 124, such as a conventional shower head or plumbing fixture.

Embodiments of the invention provide a housing 102 containing a valve stem 214 that includes a unique fluid transport network of conduits 202, 204, 206, 208, 210 and fluid bores 216, 218. The valve stem 214 is manipulated along a valve translation path 700 to selectively induce a negative pressure vacuum, and a pressurized discharge of driving fluid 304. The vacuum is generated as the pressurized driving fluid 304 is diverted through a first configuration of conduits, past a venturi channel 302, and through a secondary exit port 108; thereby creating the vacuum through adjacent, fluidly coupled conduits. The pressurized fluid discharge is generated as the pressurized driving fluid 304 is diverted directly through a series of conduits to an exit port 106.

In addition, embodiments of the invention provide a handheld suction and pressure housing assembly 114 that is in fluid communication with the housing and valve stem, through a flexible unit conduit 116. The vacuum, and the pressurized fluid discharge, work to create suction and/or pressurized fluid discharge, respectively, through a nozzle 120 in the suction and pressure housing assembly 114. Through the nozzle 120, a user can wash, shower, remove acne/oils, and perform other cleaning and personal hygiene functions by selectively switching between the vacuum position 300 and the pressurized driving fluid discharge position 400. The capacity to switch between the vacuum position and the pressurized fluid discharge position is possible through a tubular valve switch, such as a water ejector. Further, the device 100 requires only a pressurized water source, such as a shower head or sink faucet to operate.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a multi-functional shower head attachment device 100, hereafter "device 100" includes a housing 102 that is shaped and dimensioned to couple to a fluid inlet, such as a showerhead, faucet, water outlet, and other plumbing fixture known in the art. The housing 102 is defined by an intake port 104 that couples with the fluid inlet 124. The housing also has a bottom end through which an exit port 106, a secondary exit port 108, and a valve port 110 form. These lower ports 106, 108, 110 provide outlets that are in fluid communication with conduits, described below.

The device 100 further includes a fluid transport network 200 that is disposed within the housing 102. The fluid transport network 200 includes a series of conduits 202, 204, 206, 208, 210 and fluid bores 216, 218 that are coupled together to carry a pressurized driving fluid 304 and/or a negative pressure to and from the ports 106, 108, 110. The configuration of the conduits and fluid bores is selectively reconfigurable to regulate between a vacuum position 300 that creates a vacuum through the secondary exit port 108, and a pressurized discharge position 400 that creates a pressurized discharge of a driving fluid 304 through the exit port 106. Since the suction and pressure housing assembly 114 is in fluid communication with the fluid transport network 200, the suction and pressurized driving fluid are experienced at the nozzle 120 (FIGS. 9-12).

Figure 4:
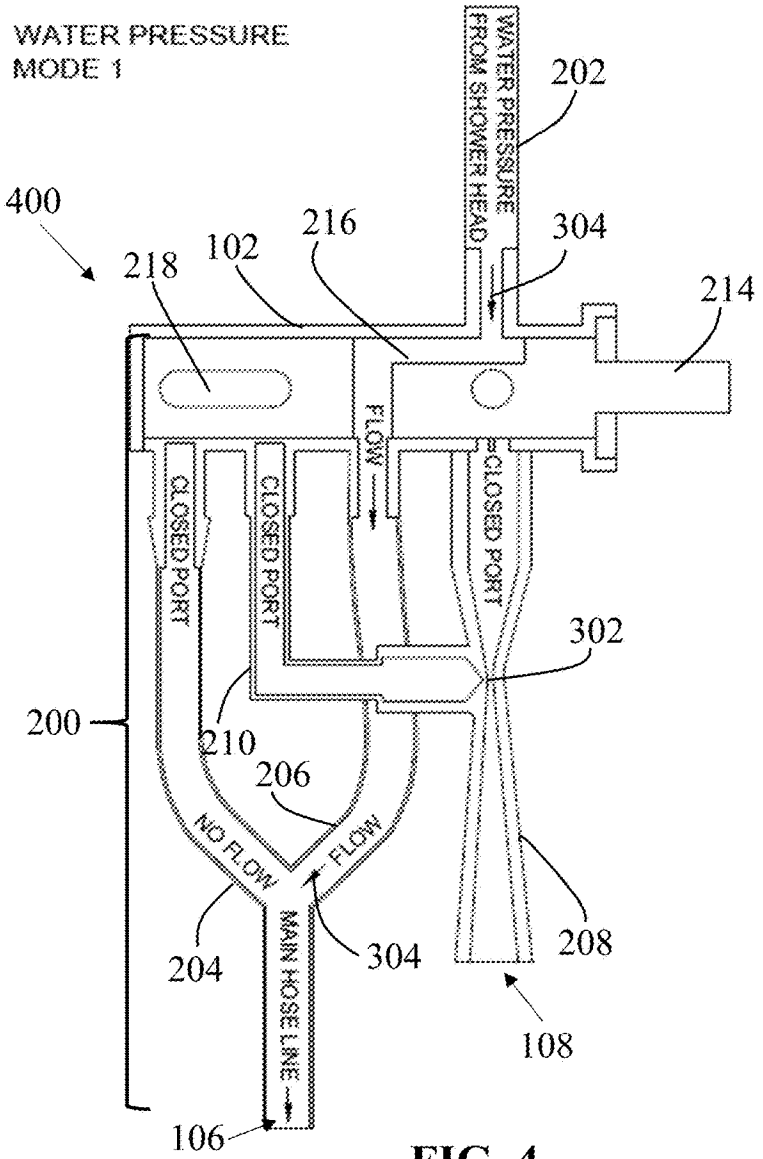
FIG. 4 is a schematic diagram of the fluid transport network configured into the pressurized fluid position, in accordance with the present invention.
Figure 3:
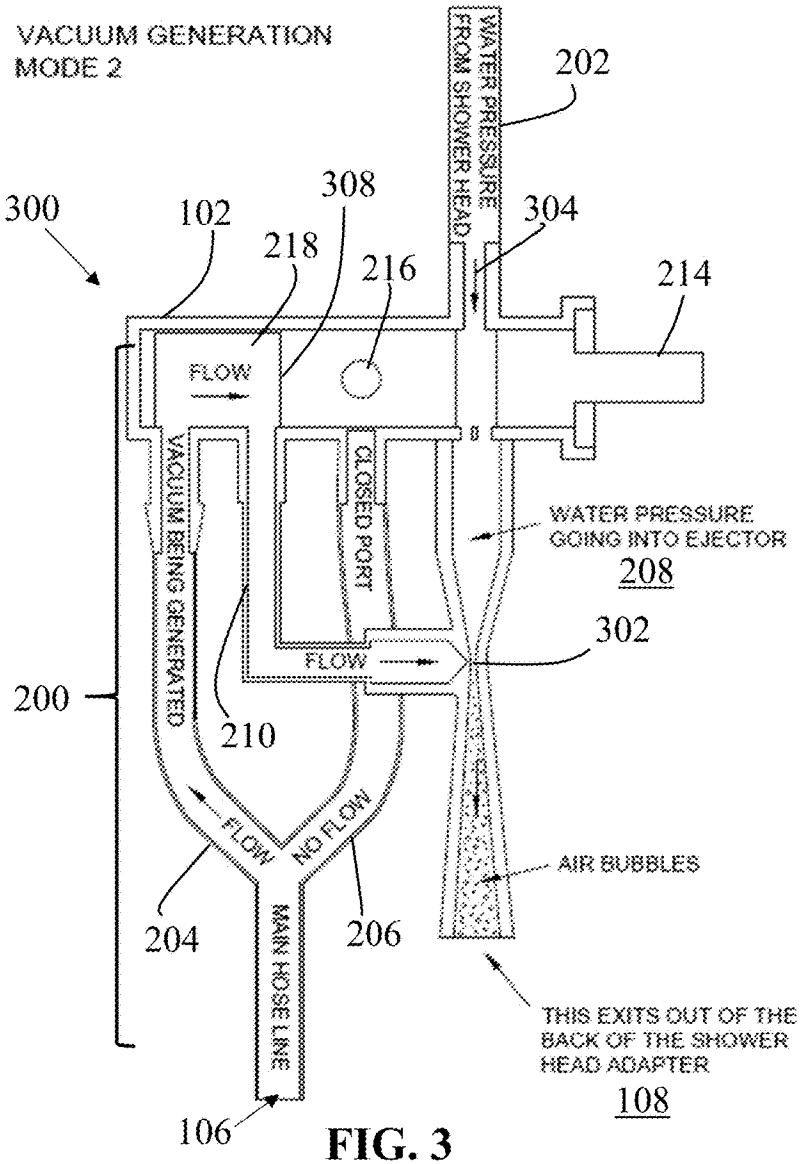
FIG. 3 is a schematic diagram of the fluid transport network configured into the vacuum position, in accordance with the present invention.

In one non-limiting embodiment, the conduits and fluid bores that constitute the fluid transport network 200 include: at least one straight tube that couples to the housing of the housing; at least one elbow tube couples to the housing; and a spout that couples to the valve housing 212. However, different types of plumbing connectors and adapters known in the art may also be used. As shown in FIGS. 3-4 the conduits are positioned to carry air and driving fluid 304 to the respective ports for effective sucking and pressurized fluid discharge.

Figure 2:
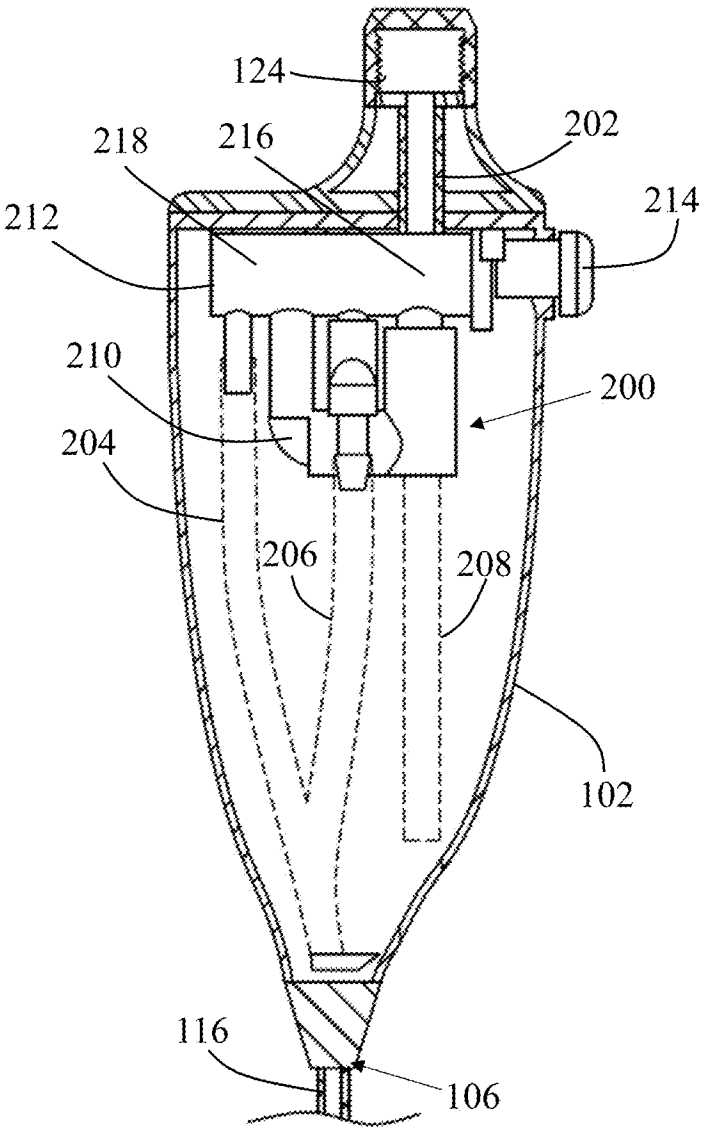
FIG. 2 is a sectioned side view of a housing and stem valve, in accordance with the present invention.

Looking now at FIG. 2, the fluid transport network 200 includes a first conduit 202 that is coupled to the intake port 104 of the housing 102. The first conduit 202 is the initial entry point for the driving fluid 304, i.e., water from showerhead. Continuing with the network of conduits, the fluid transport network 200 also has a second conduit 204 that is coupled to the exit port 106 of the housing 102. Additionally, the fluid transport network 200 has a third conduit 206 coupled to the exit port 106 of the housing 102.

As FIG. 3 illustrates, the fluid transport network 200 also has a fourth conduit 208 coupled to the secondary exit port 108 of the housing 102. In one embodiment, the fourth conduit forms a venturi channel 302, utilized to create the negative air pressure effect (sucking) through the conduits 204, 218, 210. The venturi channel 302 is defined as a restriction in the diameter of the fourth conduit 208. The fluid transport network 200 also has a fifth conduit 210 that is fluidly coupled to the fourth conduit 208 at the venturi channel 302. The vacuum effect forms in the fifth conduit 210, and all other conduits in fluid communication therewith. The vacuum is also formed through the exit port 106 and the nozzle 120 of the suction and pressure housing assembly 114, which is in fluid communication with the fluid transport network 200. Thus, the driving fluid 304 enters the first conduit, flows through the fourth conduit and the venturi channel 302, before exiting the secondary exit port 108 as air bubbles and sucked residue 306 entering the fluid transport network 200 through the exit port 106.

Those skilled in the art will recognize that a venturi creates a constriction within the fourth conduit 208 that varies the flow characteristics of the driving fluid 304 flowing therethrough. Thus, as the velocity of the driving fluid 304 increases there is a consequential drop in pressure in the fifth conduit 210 and all other conduits in fluid communication therewith. For purposes of creating a vacuum in the fluid transport network 200, the drop in pressure occurs in the second conduit 204, the secondary internal fluid bore, and the fifth conduit 210, as described below.

In some embodiments, the device 100 comprises a valve housing 212 that is disposed within and coupled to the housing 102. The valve housing 212 comprises a valve stem 214 that extends through the valve port 110 (see FIG. 2). The valve stem 214 is coupled to a valve lever 112 that can be manipulated by the hands to rotate along a valve translational path 700. The valve stem 214, through the valve lever 112, is operably configured to enable selective translation in a circular valve translation path 700 up to 90° in both directions. The stem 214 may be rotatably coupled to the valve housing 212 with one or more polymeric O-rings to facilitate in preventing fluid loss and leakage. The stem 214 may also be rotatably coupled to the valve housing 212 with one or more bearings to facilitate in easily rotating the valve stem 214. For example, the valve stem 214 may be rotated 90° in a first direction (clockwise) to configure the conduits into the vacuum position 300. Then, the valve stem 214 can be turned 90° in an opposite second direction (counterclockwise) to configure the conduits into the pressurized discharge position 400. However, in other embodiments, different valve stem manipulation mechanisms and ranges of rotation can be used.

Figure 5:
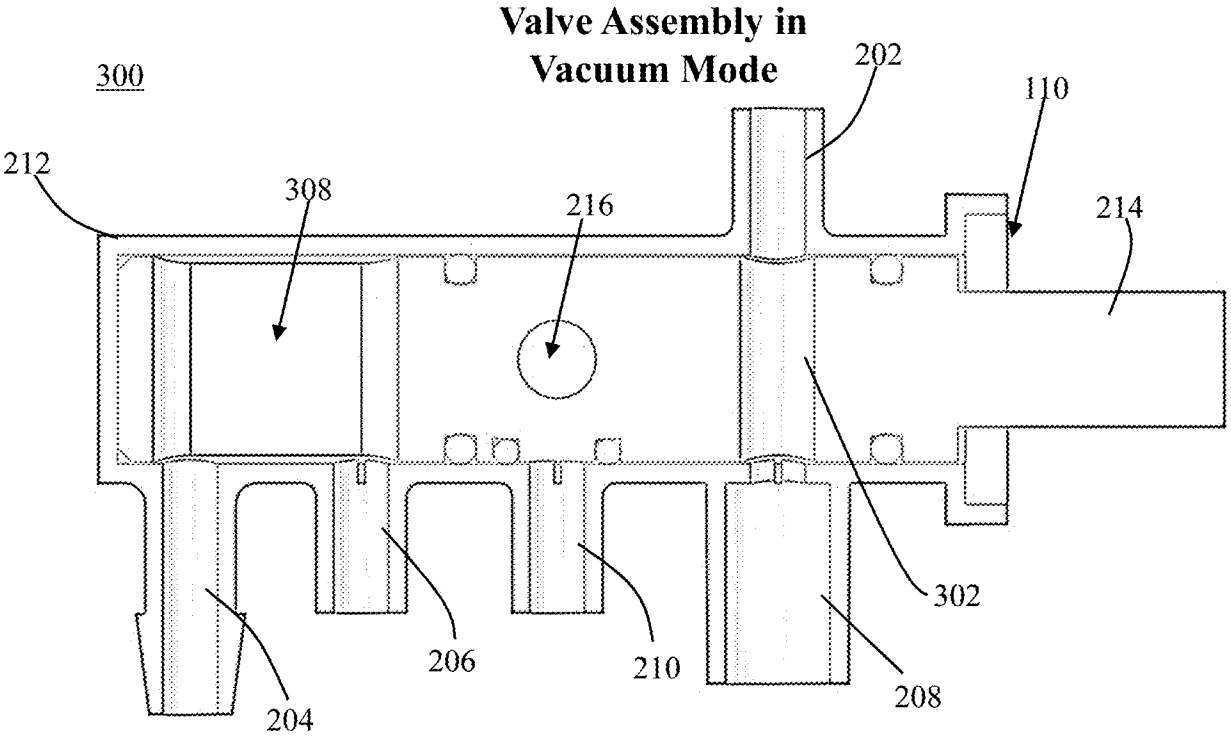
FIG. 5 is a sectioned side view of the conduits and fluid bores configured into the vacuum position, in accordance with the present invention.
Figure 6:
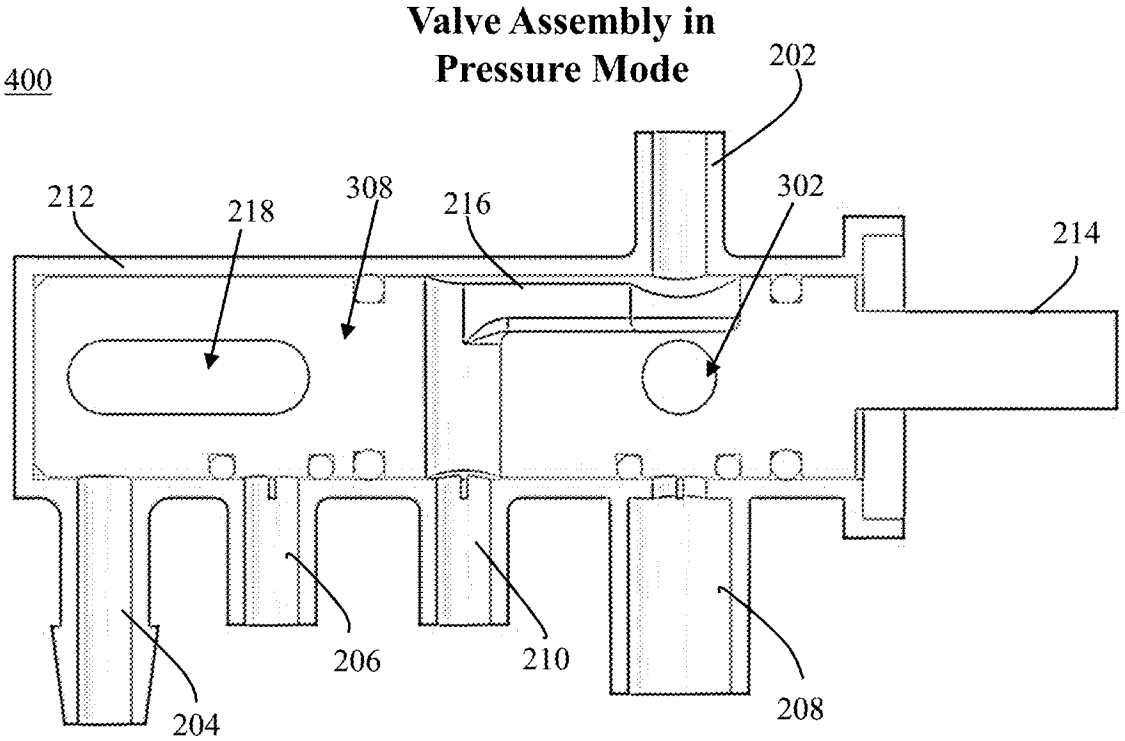
FIG. 6 is a sectioned side view of the conduits and fluid bores configured into the pressurized fluid position, in accordance with the present invention.

In this manner, when the valve translation path 700 is in the vacuum position 300, the nozzle opening is operable to suck air into the housing of the handheld suction and pressure housing assembly 114 and discharges the air through the secondary exit port 108. And when the valve translation path is in the pressurized discharge position 400, the nozzle opening 122 of the suction and pressure housing assembly 114 discharges the pressurized driving fluid 304. As FIGS. 5-6 illustrate, the valve stem 214 has an internal fluid bore 216 that can be selectively opened and closed into fluid communication with the intake port and the connected conduits and ports. The valve stem 214 further has a secondary internal fluid bore 218 defined thereon that is structurally and fluidly independent from the internal fluid bore 216. The secondary internal fluid bore 218 can also be selectively controlled to opened and closed positions in relation to adjacently connected conduits and ports.

In one possible embodiment, the valve stem 214 is moved along a valve translation path 700, which can include the 90° rotation discussed above. Through this translation path, the valve stem 214 is operably moved to a vacuum position 300 along the valve translation path 700 with the first, second, third, fourth, and fifth conduits fluidly coupled to one another, and the internal fluid bore 216 fluidly uncoupled to the first, second, third, fourth, and fifth conduits.

As FIG. 3 shows, the second conduit, the secondary internal fluid bore, and the fifth conduit are in fluid communication. The venturi channel 302 in the fourth conduit accelerates the driving fluid 304 to create the vacuum effect in these connected conduits and bore. Thus, the vacuum position 300 is configured to generate a vacuum within the second conduit 204, the secondary internal fluid bore, and the fifth conduit 210, and the exit port, which is in fluid communication with the suction and pressure housing assembly 114. FIG. 5 also shows a sectioned side view of the conduits and fluid bores configured into the vacuum position 300. Here, the conduits are configured such that the first, second, third, fourth, and fifth conduits fluidly coupled to one another, and the internal fluid bore 216 fluidly uncoupled to the first, second, third, fourth, and fifth conduits.

Turning now to FIG. 4, the translation path 700 can include reconfiguring the conduits such that the valve stem 214 is moved to achieve a pressurized discharge position 400. In the pressurized discharge position 400, the internal fluid bore, and the first, second, and third conduits are fluidly coupled to one another; and fluidly uncoupled to the fourth and fifth conduits. This works to close the fourth and fifth conduits. Thus, the driving fluid 304 is forced through the exit port 106, and subsequently through the flexible unit conduit 116 to the suction and pressure housing assembly 114 for discharge onto the skin/body. FIG. 6 illustrates a sectioned side view of the conduits and fluid bores configured into the pressurized discharge position 400. As shown, the internal fluid bore, and the first, second, and third conduits are fluidly coupled to one another; and fluidly uncoupled to the fourth and fifth conduits.

Figure 8:
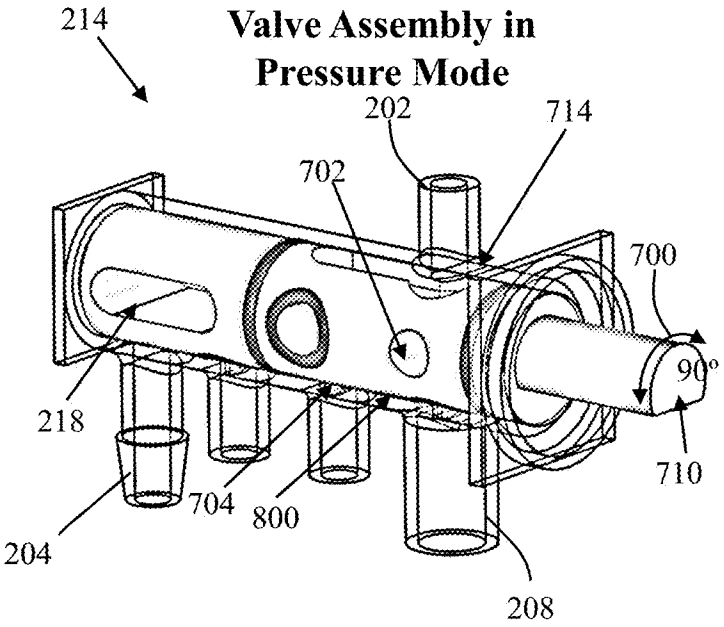
FIG. 8 is a perspective right side view of the valve stem in the pressurized fluid position, in accordance with the present invention.
Figure 7:
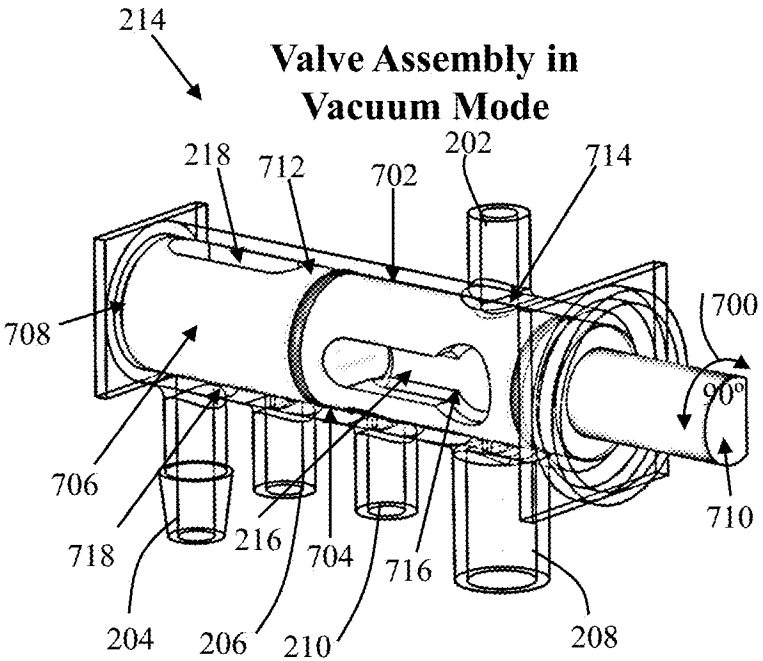
FIG. 7 is a perspective left side view of the valve stem in the vacuum position, in accordance with the present invention.

Looking at a sectioned side view of the valve stem 214, FIG. 7 shows that the valve stem 214 comprises an upper end 702, a lower end 704 opposing the upper end 702 of the valve stem 214, a left side 706, a right side 800 opposing the left side of the valve stem 214 (FIG. 8). The valve stem 214 is also defined by a left end 708, and a right end 710 opposing the left end 708 of the valve stem 214. The valve stem 214 is also defined by a stem length separating the left and right ends 708, 710 of the valve stem 214.

Looking now at FIG. 8, the valve stem also comprises an outer surface 712 surrounding the perimeter of the valve stem 214 along the stem length and defining a first enclosed aperture 714 disposed on the upper end 702 of the valve stem 214, a second enclosed aperture 1102 disposed on the lower end 704 of the valve stem 214 and aligned with the first enclosed aperture 714, a third enclosed aperture 716 disposed on the left side 702 of the valve stem 214, a fourth enclosed aperture 1104 disposed on the right side 800 of the valve stem 214, and a fifth enclosed aperture 718 disposed on the lower end 704 of the valve stem 214.

In some embodiments, the device 100 includes a fluid source (represented by numeral 128) that is in fluid communication and selectively removably couplable with the intake port 104 (FIG. 2). The fluid source 128 is operable to discharge a pressurized driving fluid 304 through the intake port. In this manner, in the vacuum position 300, the pressurized driving fluid 304 is diverted through the venturi channel 302 in the fourth conduit, and through the secondary exit port 108. Thus, when the valve translation path 700 is in the vacuum position 300, the nozzle opening 122 is operable to suck air into the housing of the handheld suction and pressure housing assembly 114 and discharges the air through the secondary exit port 108. The driving fluid 304 passing through the venturi channel 302 creates the vacuum within the second conduit, the secondary internal fluid bore, and the fifth conduit. Also, in the pressurized discharge position 400, the pressurized driving fluid 304 is diverted through the first conduit, the internal fluid bore, and the third conduit, whereby the pressurized driving fluid 304 discharges through the exit port 106. As seen in FIGS. 1-2, the device 100 may also include a head port 130 operably configured to directly couple with a conventional shower head (not shown), e.g., through a threaded attachment like other ports shown in the figures. To selectively divert the fluid source, the head 132 of the device 100 may include a push valve 134 operably configured to translate and divert flow to the head port 130 or the fluid transport network 200.

In regard to the fluid transport network 200, the vacuum position 300 along the valve translation path 700 includes the fourth enclosed aperture 1104 fluidly uncoupled to the first, second, third, fourth, and fifth conduits. The vacuum position 300 also involves the flexible unit conduit and the fifth enclosed aperture 1018 and the secondary internal fluid bore 218 fluidly coupled to the first, second, third, fourth, and fifth conduits and the flexible unit conduit. Conversely, the pressurized discharge position 400 along the valve translation path 700 includes the first and fourth enclosed apertures 1014, 1104 and the internal fluid bore 216 fluidly coupled to the first, second, and third conduits and the flexible unit conduit and the fifth enclosed aperture 1018 and the secondary internal fluid bore 218 fluidly uncoupled to the first, second, third, fourth, and fifth conduits and the flexible unit conduit. Thus, when the valve translation path is in the pressurized discharge position 400, the nozzle opening is operable to discharge the pressurized driving fluid 304.

Figure 9:
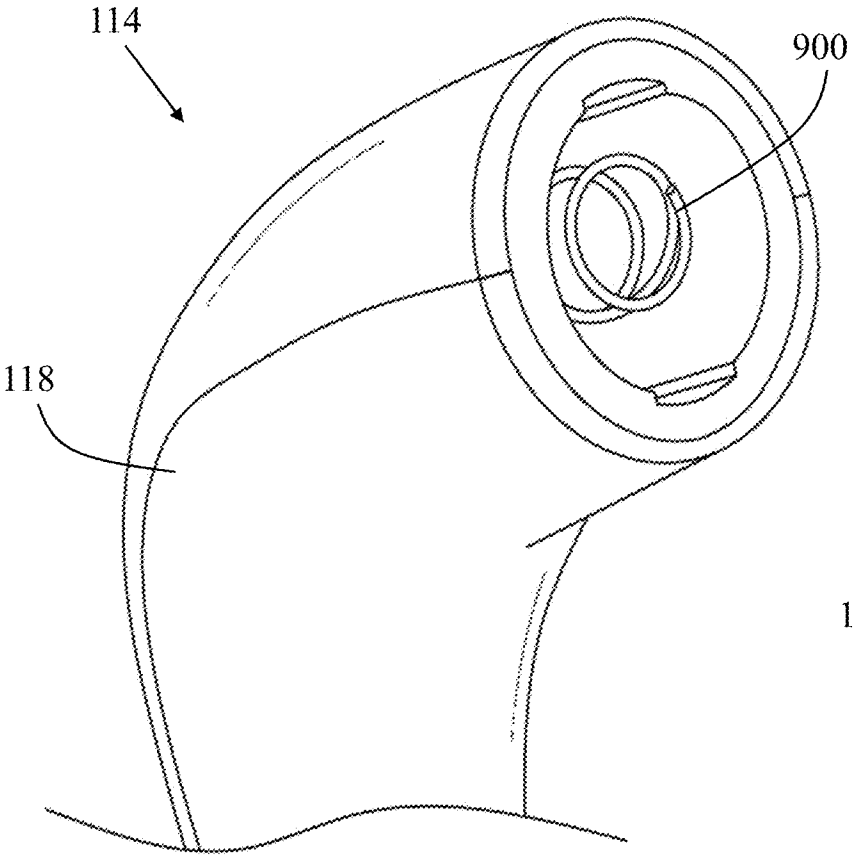
FIG. 9 is a perspective view of the handheld suction and pressure housing assembly with the nozzle removed, in accordance with the present invention.

Turning now to FIG. 9, the device 100 also includes a handheld suction and pressure housing assembly 114 that works in conjunction with the housing 102 and valve stem 214, discussed above. The suction and pressure housing assembly 114 is the component that a user grips while vacuuming oils/acne/pimples from the skin, and also while spraying the skin with pressurized driving fluid 304, i.e., water. The suction and pressure housing assembly 114 is in direct fluid communication with the valve housing. The suction and pressure housing assembly 114 includes a nozzle 120 that facilitates in inducing the vacuum or direct fluid pressure based on the position 300, 400 of the valve stem 214. In one embodiment, the handheld suction and pressure housing assembly 114 may also include a finger-sized hole, e.g., approximately 0.2-0.7 inches, defined thereon that is fluidly coupled to the nozzle 120 and is configured to enable the user to cover the finger-sized hole to selectively increase or decrease the vacuum induced through the nozzle 120. The secondary exit port 108 may also be finger-sized to enable the user to cover the finger-sized hole to selectively increase or decrease the vacuum.

Figure 10:
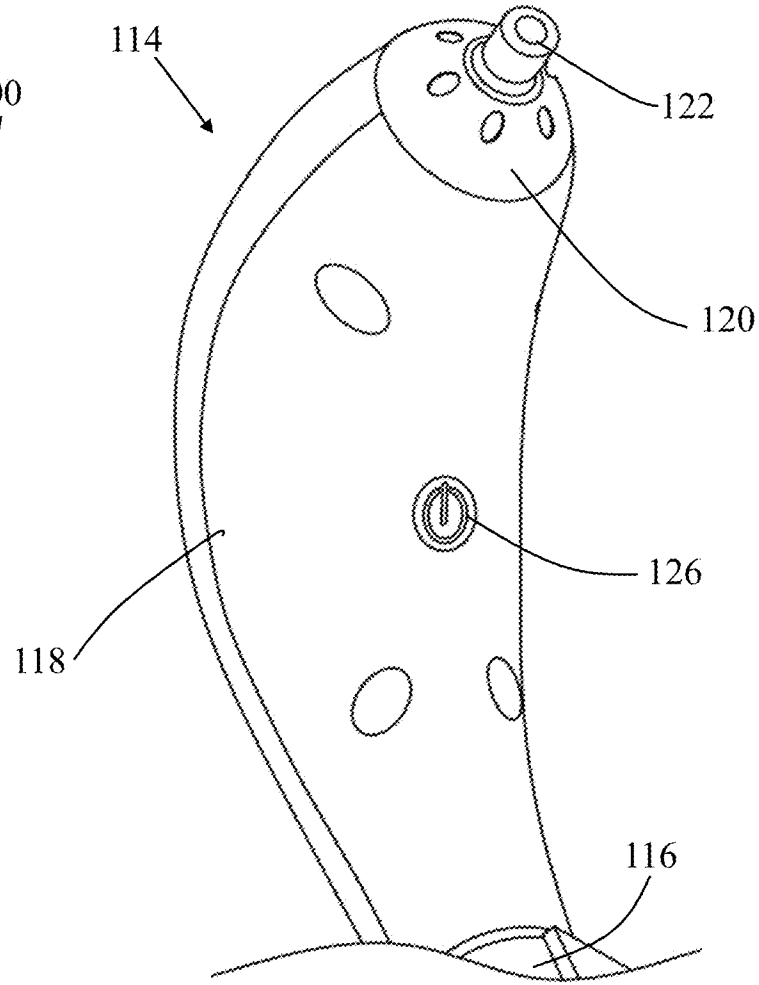
FIG. 10 is a perspective view of the handheld suction and pressure housing assembly with the nozzle, in accordance with the present invention.

As FIG. 10 illustrates, the handheld suction and pressure housing assembly 114 comprises a housing 118 that is sized and dimensioned to fit into the hand. This configuration may include a short, tubular component with smooth contours adapted to fit in a standard human hand. A control switch 126 is operable on the housing 118. The control switch 126 is configured to be in communication with the valve stem 214 to regulate powering on and off the assembly 114. The control switch 126 may also be used to control multiple spray patterns, such as a fine spray, a coarse spray, or a pulsating spray from the nozzle 120. The control switch 126 is electrically coupled to a power source, e.g., one or more lithium-ion batteries, that may also be electrically and communicatively coupled to a controller, e.g., a PCB board, that may be coupled to one or more LEDs or other electrical devices described herein.

In some embodiments, a flexible unit conduit 116 is configured to couple the housing 118 of the suction and pressure housing assembly 114 to the valve housing 212 that contains the valve stem 214. In one non-limiting embodiment, the flexible unit conduit 116 is a coiled metal tube that is sufficiently flexible to enable positioning the handheld suction and pressure housing assembly 114 along the skin and parts of the body. In some embodiments, the valve housing 212 has a nozzle 120 coupled thereto. A nozzle coupling mechanism 900, such as a spring, may be used to affix the nozzle to the opening of the valve housing 212. However, in other embodiments, the nozzle coupling mechanism 900 may include a threaded bolt or a snap-fit mechanism.

Figure 12:
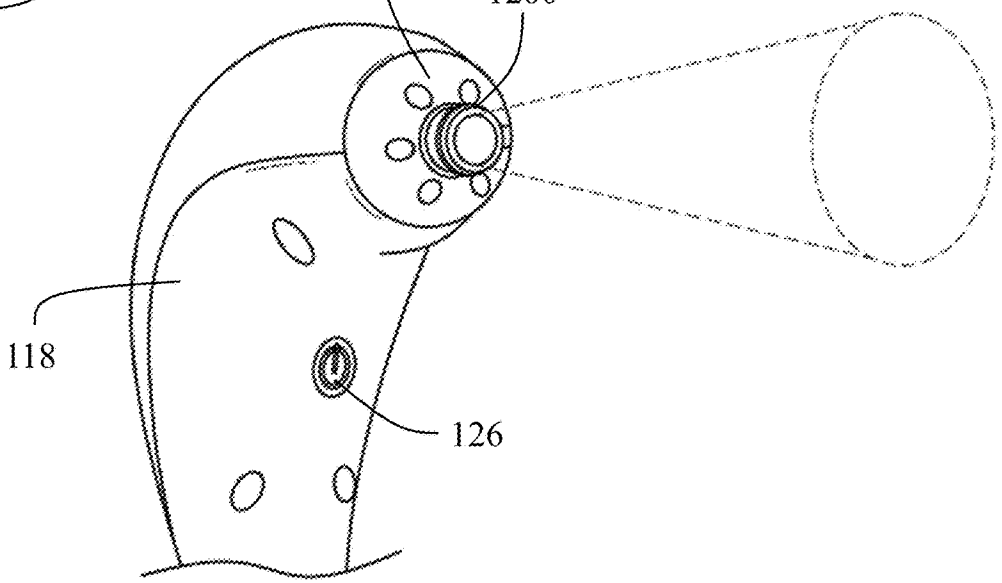
FIG. 12 is a perspective view of the handheld suction and pressure housing assembly with a secondary attachment light, in accordance with the present invention.
Figure 11:
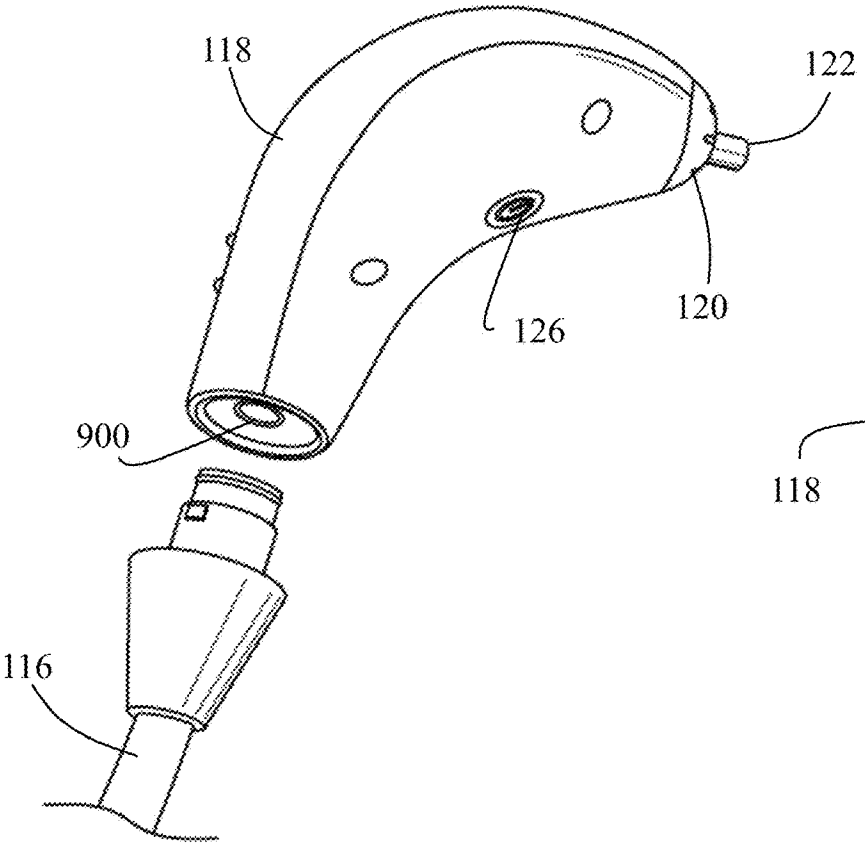
FIG. 11 is a perspective view of the handheld suction and pressure housing assembly disconnected from the flexible unit conduit, in accordance with the present invention.

FIG. 11 is a perspective view of the handheld suction and pressure housing assembly disconnected from the flexible unit conduit. In some embodiments, the nozzle 120 is fluidly coupled to the exit port 106 of the housing 102 through the flexible unit conduit 116. In this manner, the vacuum effect enables sucking through the nozzle. This can be useful for sucking blackheads and other undesirable objects from the skin. Also, the pressurized fluid is discharged through the nozzle 120, as the fluid flows through the exit port 106 to the nozzle 120. In one embodiment, the nozzle 120 defines a nozzle opening 122. The nozzle opening 122 may be configured to enable selective discharge types. For example, a wide spray can be changed to a narrow, intense stream of driving fluid 304. As FIG. 12 illustrates, the nozzle opening 122 is fluidly coupled to at least one secondary attachment 1200. In some embodiments, the secondary attachment 1200 may include, without limitation, a light source, a massage pulse nozzle, a brush, a pick, and other personal hygiene tools known in the art.

In operation, the intake port is coupled to a fluid intake, such as a plumbing fixture for a shower head. The driving fluid, which may include water, is opened through the plumbing components to generate a pressurized driving fluid through the first conduit. The valve stem 214 is rotated along the translational path 700 to a vacuum position 300. The pressurized driving fluid 304 is diverted through the venturi channel 302 through the fourth conduit, and through the secondary exit port 108. Thus, when the valve translation path 700 is in the vacuum position 300, the nozzle opening is operable to suck air into the housing of the handheld suction and pressure housing assembly 114 and discharges the air through the secondary exit port 108.

From the vacuum position, the user may then grab the handheld suction and pressure housing assembly 114, placing the nozzle along the skin to remove blackheads or other debris from the skin/body. As the suction occurs through the fourth conduit 208, air bubbles and residue are discharged through the secondary exit port 108. Next, the valve stem 214 is rotated along the translational path 700 to a pressurized fluid position 400. The pressurized driving fluid 304 is diverted through the first conduit, the internal fluid bore, and the third conduit, whereby the pressurized driving fluid 304 discharges through the exit port 106. The user may then grab the handheld suction and pressure housing assembly 114 to spray fluid onto the skin.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A multi-functional plumbing fixture attachment device with suction and pressure capability comprising:

a housing defining an intake port, an exit port, a secondary exit port, and a valve port;

a fluid transport network disposed within the housing and having a first conduit coupled to the intake port of the housing, a second conduit coupled to the exit port of the housing, a third conduit coupled to the exit port of the housing, a fourth conduit coupled to the secondary exit port of the housing, the fourth conduit forming a venturi channel, and a fifth conduit fluidly coupled to the fourth conduit at the venturi channel;

a valve housing disposed within and coupled to the housing and having a valve stem extending through the valve port and coupled to a valve lever, the valve stem having an internal fluid bore, the valve stem further having a secondary internal fluid bore defined thereon that is structurally and fluidly independent from the internal fluid bore, the valve stem being operably configured to selectively translate in a valve translation path, the valve stem operably configured to have:

a vacuum position along the valve translation path with the first, second, third, fourth, and fifth conduits fluidly coupled to one another, the internal fluid bore fluidly uncoupled to the first, second, third, fourth, and fifth conduits, and operably configured to generate a vacuum within the second conduit, the secondary internal fluid bore, and the fifth conduit;

a pressurized discharge position along the valve translation path with the internal fluid bore, the first, second, and third conduits fluidly coupled to one another and fluidly uncoupled to the fourth and fifth conduits;

a fluid source in fluid communication and selectively removably couplable with the intake port, the fluid source operable to discharge a pressurized driving fluid through the intake port, whereby in the vacuum position, the pressurized driving fluid is diverted through the venturi channel in the fourth conduit, and through the secondary exit port, whereby the driving fluid passing through the venturi channel creates the vacuum within the second conduit, the secondary internal fluid bore, and the fifth conduit, and whereby in the pressurized discharge position, the pressurized driving fluid is diverted through the first conduit, the internal fluid bore, and the third conduit, whereby the pressurized driving fluid discharges through the exit port; and a handheld suction and pressure housing assembly having a housing and a nozzle coupled to the housing, the nozzle defining a nozzle opening, the nozzle fluidly coupled to the exit port of the housing.

2. The plumbing fixture attachment device according to claim 1, wherein:

the secondary internal fluid bore is structurally and fluidly independent from the internal fluid bore by a valve wall.

3. The plumbing fixture attachment device according to claim 1, wherein:

the valve stem is operably configured to selectively translate within the valve housing and in a circular valve translation path up to 90 degrees.

4. The plumbing fixture attachment device according to claim 1, wherein the valve stem further comprises:

an upper end, a lower end opposing the upper end of the valve stem, a left side, a right side opposing the left side of the valve stem, a left end, and a right end opposing the left end of the valve stem, and a stem length separating the left and right ends of the valve stem; and an outer surface surrounding the perimeter of the valve stem along the stem length and defining a first enclosed aperture disposed on the upper end of the valve stem, a second enclosed aperture disposed on the lower end of the valve stem and aligned with the first enclosed aperture, a third enclosed aperture disposed on the left side of the valve stem, a fourth enclosed aperture disposed on the right side of the valve stem, and a fifth enclosed aperture disposed on the lower end of the valve stem.

5. The plumbing fixture attachment device according to claim 1, further comprising:

a flexible unit conduit coupling the housing of the handheld suction and pressure housing assembly, and the valve housing.

6. The plumbing fixture attachment device according to claim 5, wherein:

the vacuum position along the valve translation path includes the fourth enclosed aperture fluidly uncoupled to the first, second, third, fourth, and fifth conduits and the flexible unit conduit and the fifth enclosed aperture and the secondary internal fluid bore fluidly coupled to the first, second, third, fourth, and fifth conduits and the flexible unit conduit.

7. The plumbing fixture attachment device according to claim 6, wherein:

the pressurized discharge position along the valve translation path includes the first and fourth enclosed apertures and the internal fluid bore fluidly coupled to the first, second, and third conduits and the flexible unit conduit and the fifth enclosed aperture and the secondary internal fluid bore fluidly uncoupled to the first, second, third, fourth, and fifth conduits and the flexible unit conduit.

8. The plumbing fixture attachment device according to claim 1, wherein:

the conduits of the fluid transport conduct network include at least one of the following: at least one straight tube coupled to the housing of the housing, at least one elbow tube coupled to the housing, and a spout coupled to the valve housing.

9. The plumbing fixture attachment device according to claim 1, wherein:

when the valve translation path is in the vacuum position, the nozzle opening is operable to suck air into the housing of the handheld suction and pressure housing assembly and discharges the air through the secondary exit port.

10. The plumbing fixture attachment device according to claim 1, wherein:

when the valve translation path is in the pressurized discharge position, the nozzle opening is operable to discharge the pressurized driving fluid.

11. The plumbing fixture attachment device according to claim 1, wherein:

the nozzle opening is fluidly coupled to at least one secondary attachment.

12. The plumbing fixture attachment device according to claim 1, wherein:

the plumbing fixture comprises a showerhead.

13. A plumbing fixture attachment device with suction and pressure capability comprising:

a housing defining an intake port, an exit port, a secondary exit port, and a valve port;

a valve housing disposed within and coupled to the housing and having a valve stem extending through the valve port and coupled to a valve lever, the valve stem having an internal fluid bore and operably configured to selectively translate in a valve translation path;

a fluid transport conduit network disposed within the housing and having a first conduit structurally coupled to the valve housing and coupled to the intake port of the housing, a second conduit structurally coupled to the valve housing and coupled to the exit port of the housing, a third conduit structurally coupled to the valve housing and coupled to the exit port of the housing, a fourth conduit structurally coupled to the valve housing and coupled to the secondary exit port of the housing, and a fifth conduit structurally coupled to the valve housing and fluidly coupled to the fourth conduit; and a handheld suction and pressure housing assembly having a housing and a nozzle coupled to the housing and defining a nozzle opening fluidly coupled to the exit port of the housing through a flexible unit conduit coupled to the housing of the handheld suction and pressure housing assembly and the valve housing, the valve stem operably configured to have:

a vacuum position along the valve translation path with the first, second, third, fourth, and fifth conduits and the flexible unit conduit fluidly coupled to one another, the internal fluid bore fluidly uncoupled to the first, second, third, fourth, and fifth conduits and the flexible unit conduit, and operably configured to generate a vacuum within the second and fifth conduits; and a pressurized discharge position along the valve translation path with the internal fluid bore, the first, second, and third conduits, and the flexible unit conduit fluidly coupled to one another and fluidly uncoupled to the fourth and fifth conduits.

14. The plumbing fixture attachment device according to claim 13, further comprising:

a secondary internal fluid bore structurally and fluidly independent from the internal fluid bore by a valve wall.

15. The plumbing fixture attachment device according to claim 13, wherein:

the conduits of the fluid transport conduct network include at least one of the following: at least one straight tube coupled to the housing, at least one elbow tube coupled to the housing, and a spout coupled to the valve housing.

16. The plumbing fixture attachment device according to claim 13, wherein the valve stem further comprises:

an upper end, a lower end opposing the upper end of the valve stem, a left side, a right side opposing the left side of the valve stem, a left end, and a right end opposing the left end of the valve stem, and a stem length separating the left and right ends of the valve stem; and an outer surface surrounding the perimeter of the valve stem along the stem length and defining a first enclosed aperture disposed on the upper end of the valve stem, a second enclosed aperture disposed on the lower end of the valve stem and aligned with the first enclosed aperture, a third enclosed aperture disposed on the left side of the valve stem, a fourth enclosed aperture disposed on the right side of the valve stem, and a fifth enclosed aperture disposed on the lower end of the valve stem.

17. The plumbing fixture attachment device according to claim 16, wherein:

the vacuum position along the valve translation path includes the fourth enclosed aperture fluidly uncoupled to the first, second, third, fourth, and fifth conduits and the flexible unit conduit and the fifth enclosed aperture and secondary internal fluid bore fluidly coupled to the first, second, third, fourth, and fifth conduits and the flexible unit conduit, and wherein the pressurized discharge position along the valve translation path includes the first and fourth enclosed apertures and the internal fluid bore fluidly coupled to the first, second, and third conduits and the flexible unit conduit and the fifth enclosed aperture and the secondary internal fluid bore fluidly uncoupled to the first, second, third, fourth, and fifth conduits and the flexible unit conduit.

18. The plumbing fixture attachment device according to claim 13, wherein:

the fourth conduit forms a venturi channel.

19. The plumbing fixture attachment device according to claim 18, further comprising:

a fluid source in fluid communication and selectively removably couplable with the intake port, the fluid source operable to discharge a pressurized driving fluid through the intake port, whereby in the vacuum position, the pressurized driving fluid is diverted through the venturi channel in the fourth conduit, and through the secondary exit port, whereby the driving fluid passing through the venturi channel creates the vacuum within the second conduit, the secondary internal fluid bore, and the fifth conduit, and whereby in the pressurized discharge position, the pressurized driving fluid is diverted through the first conduit, the internal fluid bore, and the third conduit, whereby the pressurized driving fluid discharges through the exit port.

20. A multi-functional plumbing fixture attachment device with suction and pressure capability comprising:

a housing defining an intake port, an exit port, a secondary exit port, and a valve port;

a fluid transport network disposed within the housing and having a first conduit coupled to the intake port of the housing, a second conduit coupled to the exit port of the housing, a third conduit coupled to the exit port of the housing, a fourth conduit coupled to the secondary exit port of the housing, the fourth conduit forming a venturi channel, and a fifth conduit fluidly coupled to the fourth conduit at the venturi channel, the conduits of the fluid transport conduct network including at least one of the following: at least one straight tube coupled to the housing, at least one elbow tube coupled to the housing, and at least one spout;

a valve housing disposed within and coupled to the housing and having a valve stem extending through the valve port and coupled to a valve lever, the valve stem having an internal fluid bore, the valve stem further having a secondary internal fluid bore defined thereon that is structurally and fluidly independent from the internal fluid bore, the valve stem being operably configured to selectively translate in a circular valve translation path up to 90 degrees, the valve stem operably configured to have:

a vacuum position along the valve translation path with the first, second, third, fourth, and fifth conduits fluidly coupled to one another, the internal fluid bore fluidly uncoupled to the first, second, third, fourth, and fifth conduits, and operably configured to generate a vacuum within the second conduit, the secondary internal fluid bore, and the fifth conduit;

a pressurized discharge position along the valve translation path with the internal fluid bore, the first, second, and third conduits fluidly coupled to one another and fluidly uncoupled to the fourth and fifth conduits; and a fluid source in fluid communication and selectively removably couplable with the intake port, the fluid source operable to discharge a pressurized driving fluid through the intake port, whereby in the vacuum position, the pressurized driving fluid is diverted through the venturi channel in the fourth conduit, and through the secondary exit port, whereby the driving fluid passing through the venturi channel creates the vacuum within the second conduit, the secondary internal fluid bore, and the fifth conduit, and whereby in the pressurized discharge position, the pressurized driving fluid is diverted through the first conduit, the internal fluid bore, and the third conduit, whereby the pressurized driving fluid discharges through the exit port;

a handheld suction and pressure housing assembly having a housing and a nozzle coupled to the housing, the nozzle defining a nozzle opening; and a flexible unit conduit fluidly coupling the housing of the handheld suction and pressure housing assembly to the valve housing.

* * * * *